US008230832B2

(12) United States Patent
Isenberg et al.

(10) Patent No.: US 8,230,832 B2
(45) Date of Patent: Jul. 31, 2012

(54) VANE-TYPE CAMSHAFT ADJUSTER

(75) Inventors: Karl Heinz Isenberg, Trier (DE); Fatih Dogan, Frickenhausen (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 439 days.

(21) Appl. No.: 12/549,070

(22) Filed: Aug. 27, 2009

(65) Prior Publication Data

US 2010/0075765 A1 Mar. 25, 2010

(51) Int. Cl.
*F01L 1/34* (2006.01)

(52) U.S. Cl. ..... 123/90.17; 123/90.15; 123/90.31

(58) Field of Classification Search ..... 123/90.15, 123/90.16, 90.17, 90.31, 90.33, 90.38, 195 C
See application file for complete search history.

(56) References Cited

U.S. PATENT DOCUMENTS

| | | | | |
|---|---|---|---|---|
| 6,155,219 | A | 12/2000 | Fukuhara | |
| 6,276,321 | B1 * | 8/2001 | Lichti et al. | 123/90.17 |
| 7,004,129 | B2 | 2/2006 | Schneider | |
| 2002/0152977 | A1 | 10/2002 | Eguchi et al. | |

FOREIGN PATENT DOCUMENTS

| | | | |
|---|---|---|---|
| DE | 69417150 | T2 | 7/1999 |
| DE | 10212606 | A1 | 10/2002 |
| DE | 10215879 | A1 | 10/2003 |
| EP | 0 356 018 | A1 | 2/1990 |
| EP | 0652354 | A1 | 10/1995 |

* cited by examiner

*Primary Examiner* — Zelalem Eshete
(74) *Attorney, Agent, or Firm* — Polster, Lieder, Woodruff & Lucchesi, L.C.

(57) ABSTRACT

A vane-type camshaft adjuster has a side plane that is arranged perpendicular to the center axis of the camshaft adjuster. A coil spring abuts the side plane and is connected between a rotor and stator to maintain the rotor at a certain angular position relative to the stator.

In order to create a vane-type camshaft adjuster, the righting moments of which are adjusted in a particularly accurate manner, the coil spring has a rectangular profile, wherein a spring section is angled through the side plane such that the coil spring is supported relative to the stator or the rotor in a pivot-proof positive fitting manner.

9 Claims, 4 Drawing Sheets

VANE-TYPE CAMSHAFT ADJUSTER

CROSS-REFERENCE TO RELATED APPLICATIONS

This application claims priority under 35 U.S.C. §119 to German App. No. 10 2008 048 386.9, filed Sep. 22, 2008, and which is incorporated herein by reference.

BACKGROUND

The invention relates to a vane-type camshaft adjuster according to the generic part of patent claim 1.

A vane-type camshaft adjuster is already known from U.S. Pat. No. 7,004,129 B2. A coil spring is seated on a side plane of a stator that is arranged perpendicular to the center axis thereof. The coil spring strives to maintain a rotor at a certain angular position against the stator. The coil spring comprises a wire having a round profile. The wire is supported on the stator on the outer end opposite of protrusions by means of a first bend. The coil spring is supported opposite of the rotor on the inner end by means of a second bend.

A camshaft adjusting device of a different type is known from EP 0 356 018 A1, wherein a coil spring having a rectangular profile is utilized.

A vane-type camshaft adjuster having a coil spring, and being made of a round wire, is further known from U.S. Pat. No. 6,155,219.

SUMMARY OF THE DISCLOSURE

The object of the invention is to create a vane-type camshaft adjuster, the righting moments of which are adjusted in a particularly accurate manner.

According to an advantage of the invention, a vane-type camshaft adjuster is being utilized. The vane-type camshaft adjuster is dimensioned in an axially very short manner, which benefits the tight installation space of drive trains installed both in transverse and longitudinal directions.

According to another advantage of the invention, a coil spring having a rectangular profile supports the rotor opposite of the stator at a certain angular position. In case of the camshaft being associated with the exhaust, the rotor may be brought into an early exhaust camshaft position required for starting the motor by means of the coil spring. In general the alternating torques of the camshaft may be compensated in both camshafts—i.e. intake and exhaust—by means of prestressing the coil spring, which have an effect, the strength of which varies in both torque devices of the camshaft. The alternating torques are created by means of the valve spring forces applied to the gas shuttle valves, and strongly depend on the number of cylinders. The alternating torques become increasingly inhomogeneous, the fewer cylinders are present in the internal combustion engine. For this purpose the coil spring may be rotated "early" into the torque direction in idle position in a particularly advantageous manner, since the adjustment of the vane-type camshaft adjuster in the torque device setting "late" already occurs quicker due to the supporting effect by means of the alternating torques. In this manner the adjustment to "early" is carried out just as quickly as in "late" by means of the coil spring.

A coil spring having a rectangular profile may be produced having particularly low tolerances. In this manner the rectangular wire of the coil spring may be gripped particularly well by a clamping device, and subsequently bent. In this case the bent angular area enables the coil spring to be further held in the bent angular area by a clamping device, and to wind the coil to an exact measure. For example, a round wire would be difficult to grip using a clamping device in this case, since such a round wire can be gripped only in a negative fitting and not in a positive fitting manner. For this purpose the winding is accomplished essentially about the center axis of the coil spring. For this purpose, however, the coil spring is not exactly evenly wound, since some of the windings of the coil spring are to abut each other such that a friction torque is created during pretensioning of the coil spring in this area, which prevents vibrations of the coil spring. The friction torque, thus acting in an attenuating manner, may therefore also be adjusted precisely due to the rectangular profile.

In order to utilize the entire length of the coil spring the bent or angled area may be the outer end of the coil spring that is advantageously positioned radially with regard to the center axis.

In a particularly advantageous manner the radial outer end of the coil spring is angled at an angle of just below 90°—preferably 88°, in the unstressed state of the vane-type camshaft adjuster. In this manner it is achieved that the coil spring abuts the side plane, at least during the operation of the camshaft adjuster, and attenuates via friction. This prevents the coil spring from vibrating during operation, and jumping out from the mounts. The angle may be chosen in a particularly advantageous further improvement such that the coil spring abuts the side plane already in the unstressed state of the camshaft adjuster. The attenuating and operational safety measure is of particular advantage, if the coil spring abuts the camshaft adjuster in an open manner—i.e. without a protective cover. The angle of below 90° bends only slightly during operation due to its stiffness such that a lock against rotation as opposed to the stator is still ensured.

Analogously, the radial inner end may be mounted in a pivot-proof manner against the rotor. For this purpose the inner end may be tucked into an accommodating recess of the rotor, for example, by means of the side plane. However, in many cases it is more advantageous for the pivot-proof connection, as opposed to the rotor, to bend the coil spring toward the interior at the radial inner end thereof, and to allow the same to engage into a radially aligned recess of a component that is connected to the rotor in a pivot-proof manner, or is configured on the rotor in one piece. Such a component being pivot-proof connected to the rotor is the so-called spring adapter.

In accordance with one aspect of the camshaft adapter, the rectangular profile of the coil spring has two edge lengths that are positioned opposite of each other, wherein the other two edge lengths deviate from each other, wherein the shorter edge lengths are facing the side plane, or are facing away from the same, respectively. Simplified, this means that the rectangular profile of the coil spring is positioned on the side plane in an "upright" manner. Thus, the coil spring is bent in a most advantageous manner at the angled area in the stiffer direction. In this manner the angled area is also more difficult to bend out during the operation of the vane-type camshaft adjuster such that the spring may not slip out of the mount on the stator. The coil spring is also softer in the pivoting direction about the center axis, improving the function thereof. It is also possible at this alignment of the profile to accommodate more windings at more friction in the same installation space.

Further advantages of the invention are obvious from the further patent claims, the description, and the drawing.

BRIEF DESCRIPTION OF THE DRAWINGS

The invention is explained in further detail based on an exemplary embodiment.

The figures show.

DESCRIPTION OF THE DISCLOSURE

Figure 1:
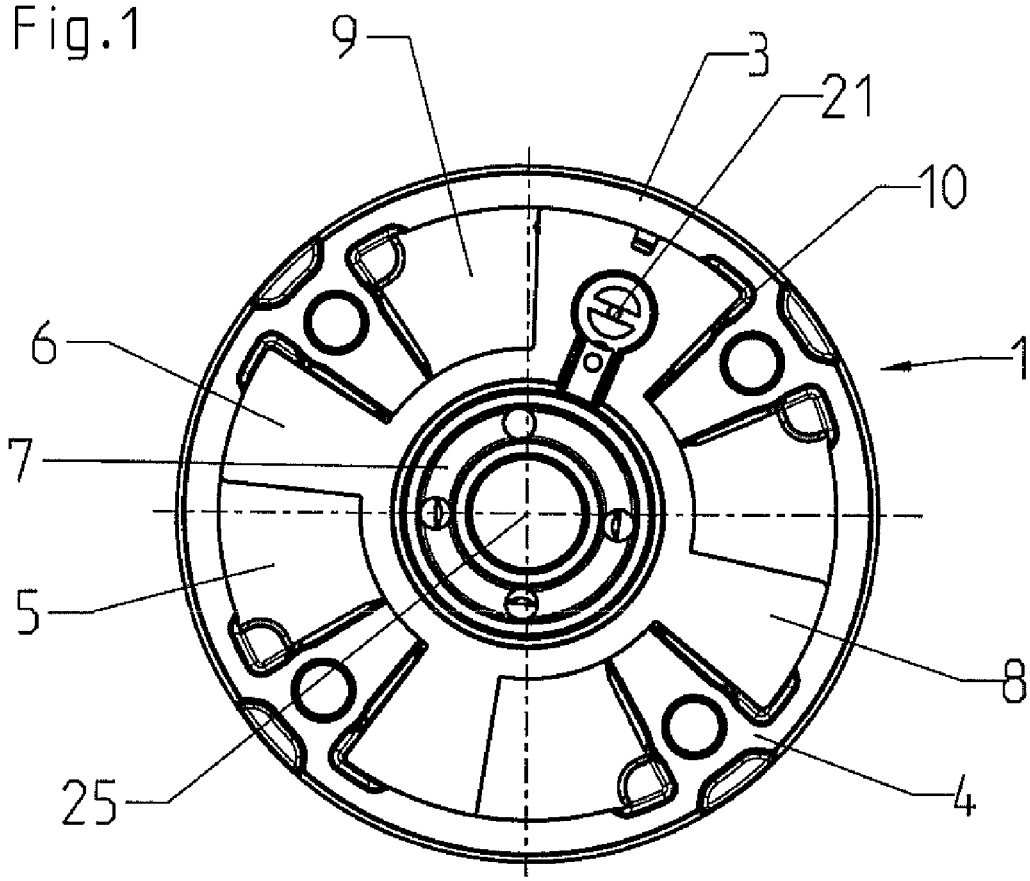
FIG. 1 a vane-type camshaft adjuster.

The angular position between the crankshaft and the camshaft is modified using a vane-type camshaft adjuster during the operation of an internal combustion engine. By pivoting the camshaft the opening and closing times of the gas shuttle valves are displaced such that the internal combustion engine delivers its optimum power at the respective rotational speed. The vane-type camshaft adjuster enables an infinitely variable adjustment of the camshaft relative to the crankshaft. The vane-type camshaft adjuster has a cylindrical stator 1 that is connected to a gearwheel 2 illustrated in FIG. 2 in a pivot-proof manner. In the exemplary embodiment the gearwheel 2 is a chain wheel, via which a chain (not illustrated in detail) is guided. However, the gearwheel 2 may also be a toothed belt wheel, via which a drive belt is guided as the drive element. The stator 1 is drive-connected to the crankshaft via the drive element and the gearwheel 2 in a commonly known manner.

As an alternative, the stator 1 and the gearwheel 2 may also be integrally formed in one piece, if the other side of the stator 1 is to be opened. For this purpose the stator 1 and the gearwheel 2 may also be comprised of a metal material, or also of a hard plastic material. Suitable metal materials are, among others, sintered metal, sheet steel, and aluminum. The stator 1 comprises a cylindrical stator base body 3, at the interior side of which bars 4 project radially toward the interior at even distances. Pressure chambers 5 are created between adjacent bars 4, into which a pressure medium is incorporated via a 4/3-way valve (not illustrated in detail). Vanes 6, which extend radially toward the exterior of a cylindrical rotor base housing 7 of a rotor 8, protrude between adjacent bars 4. The vanes 6 subdivide the pressure chambers 5 between the bars 4 into two pressure chambers 9 and 10 each.

At their front sides the bars 4 abut the exterior lateral area of the rotor base body 7 in a sealing manner. The vanes 6 in turn abut the cylindrical interior wall of the stator base body 3 at the front sides thereof in a sealing manner.

The rotor 8 is connected to the camshaft (not illustrated in detail) in a pivot-proof manner. In order to modify the angular position between the camshaft and the crankshaft the rotor 8 is pivoted relative to the stator 1. For this purpose the pressure medium in the pressure chambers 9 or 10 is pressurized depending on the desired pivoting direction, while the other pressure chambers 10 or 9 are released toward the tank.

Figure 2:
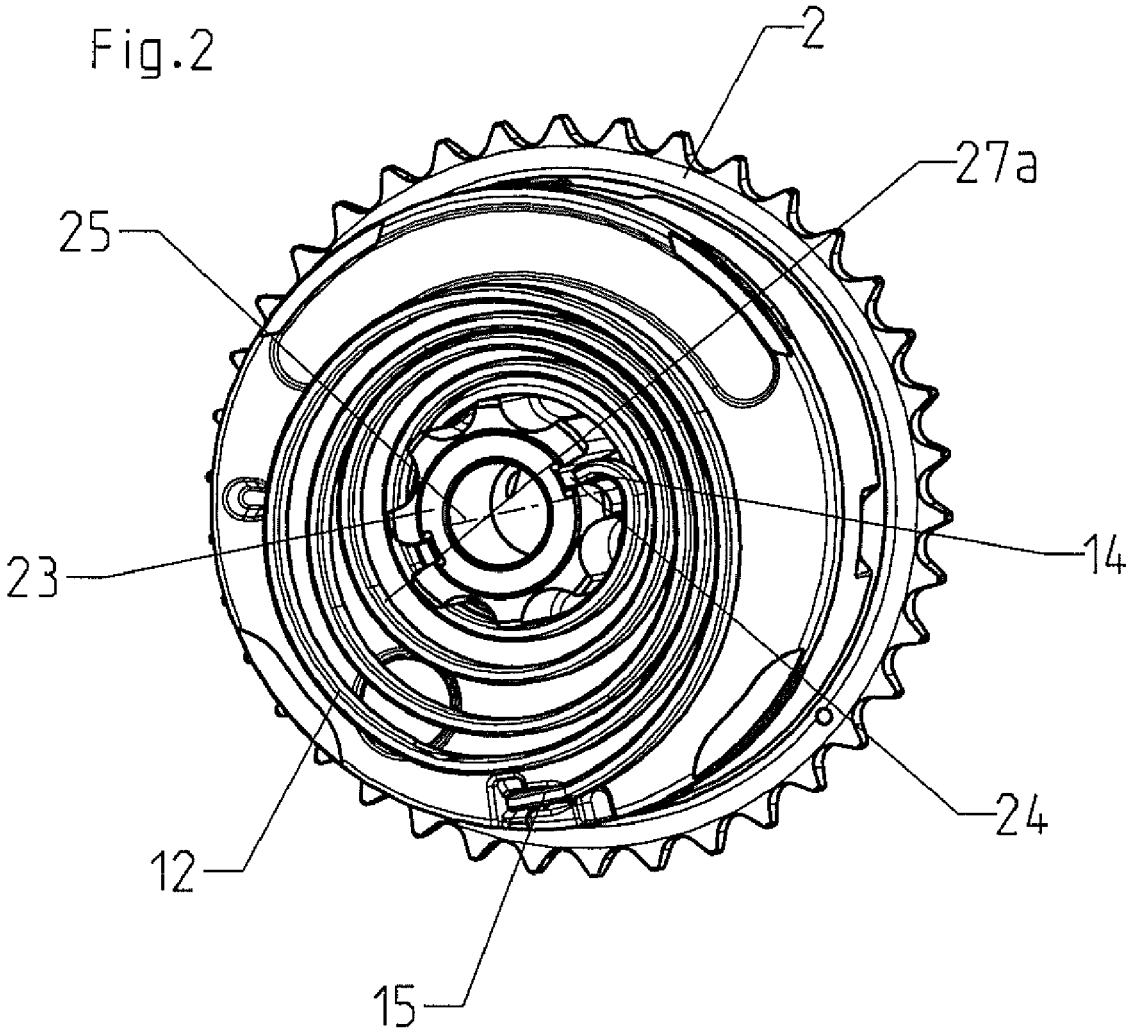
FIG. 2 the vane-type camshaft adjust of FIG. 1 in a perspective view from the exterior, wherein, among others, a stator cover and a coil spring can be seen, FIG. 3 a sectional view of the stator cover of FIG. 2 illustrated in the area of an accommodating recess for the coil spring, and FIG. 4 a detail of FIG. 3 in the area of the accommodating recess, wherein a section extends across the coil spring.
Figure 3:
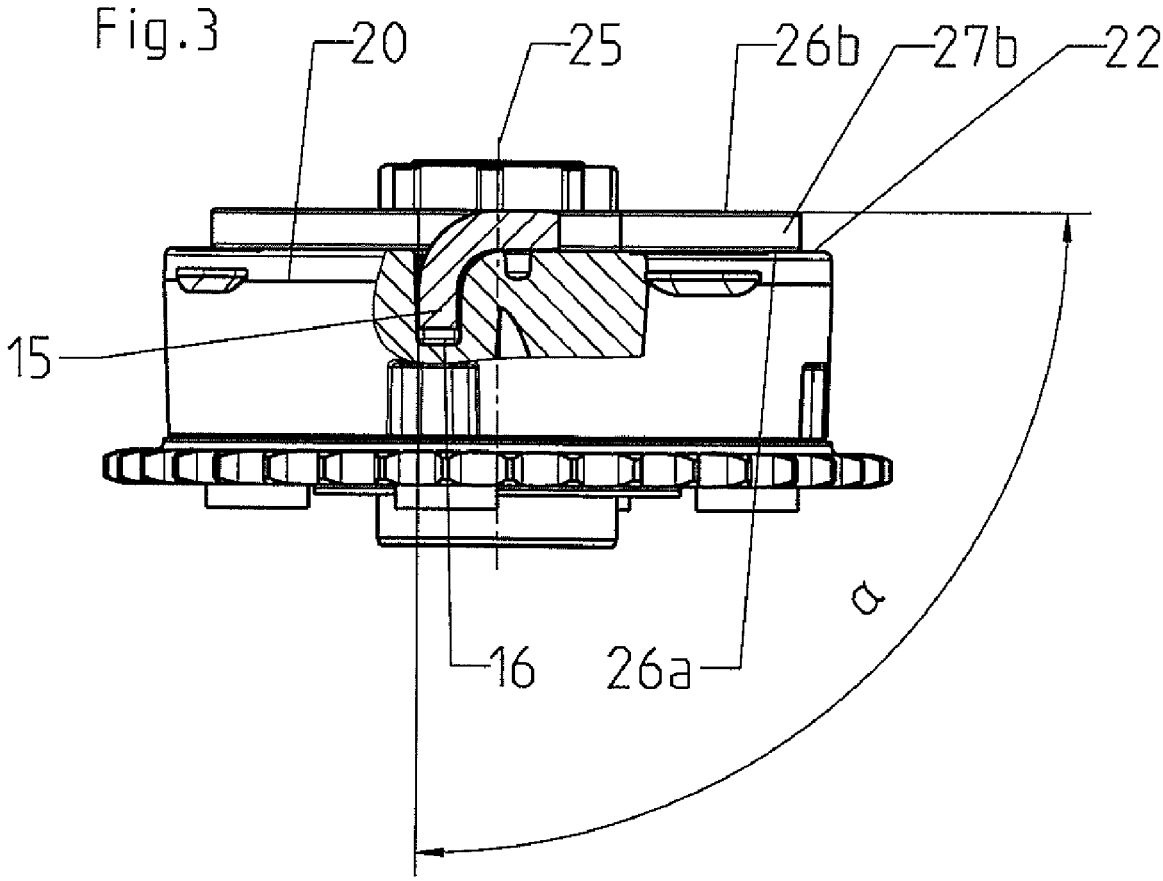

The stator 1 is embodied in one piece as a bowl-shaped stator cover as seen in FIG. 2, which is firmly screwed onto the gearwheel 2. For this purpose the stator cover is embodied as a cast part having a cast edge 20. The front faces of the bars 4 and of the vanes 6 closely abut both the gearwheel 2 and the stator cover. The stator cover and the gearwheel 2 also limit the pressure chambers 5 between the vanes 4 in axial direction. So that the rotor 8 assumes the early exhaust camshaft position required for starting the motor in a switched off internal combustion engine—i.e. in an unstressed vane-type camshaft adjuster—the rotor 8 is pivoted by means of a coil spring 12 into an initial position. In this initial position a locking occurs between the rotor 8 and the stator 1, for example, by means of a spring-loaded locking bolt 21, which is accommodated in the vane 6. In case of a drop in pressure in the pressure chambers 9, 10, the locking bolt 21 is moved into a locking position by means of the spring force of a helical compression spring (not illustrated in detail), in which the locking bolt engages into a locking opening of the stator 1. When the motor is started, the locking bolt 21 is stressed against the spring force by means of the pressure medium and pushed back such that the rotor 8 is unlocked by the stator 1, and the vane-type camshaft adjuster may reach its control position.

The coil spring 12 abuts a side plane 22 which is arranged on the stator cover perpendicular to the center axis of the vane-type camshaft adjuster. The coil spring 12 is connected to the rotor 8 in a pivot-proof manner at its radial inner end 14. The radial outer end 15 of the coil spring is supported on the stator 1 in a pivot-proof and positive fitting manner. For this purpose the radial outer end 15 of the coil spring 12 is angled at an angle $\alpha$ of 88° in the unstressed state of the vane-type camshaft adjuster. For this purpose the angled end 15 is tucked into an accommodating recess 16 of the stator 1. The radial inner end 14 of the coil spring 12 is bent radially toward the interior, and engages into a radially aligned accommodating recess 24 of a spring adapter 23 that is connected to the rotor 8 in a pivot-proof manner. The spring adapter 23 has a pin (not illustrated in detail) that is inserted into a hub of the rotor 8 by means of press fit. In this manner the spring adapter 23 is pivot-proof relative to the rotor 8. The radial inner end 14 of the coil spring is radially bent toward the interior, and the radial accommodating recess 24 point to the center axis 25 of the vane-type camshaft adjuster.

The coil spring 12 has a rectangular profile, which abuts the side plane 22 in an "upright" manner. This means that two opposite edge lengths 26*a*, 26*b* of the rectangular profile deviate from the two other edge lengths 27*a*, 27*b*. The one short edge length 26*a* faces the side plane 22, whereas the other short edge length 26*b* faces away from the side plane 22. The one long edge length 27*a* faces radially toward the interior, whereas the other long edge length 27*b* faces radially toward the exterior.

Figure 4:
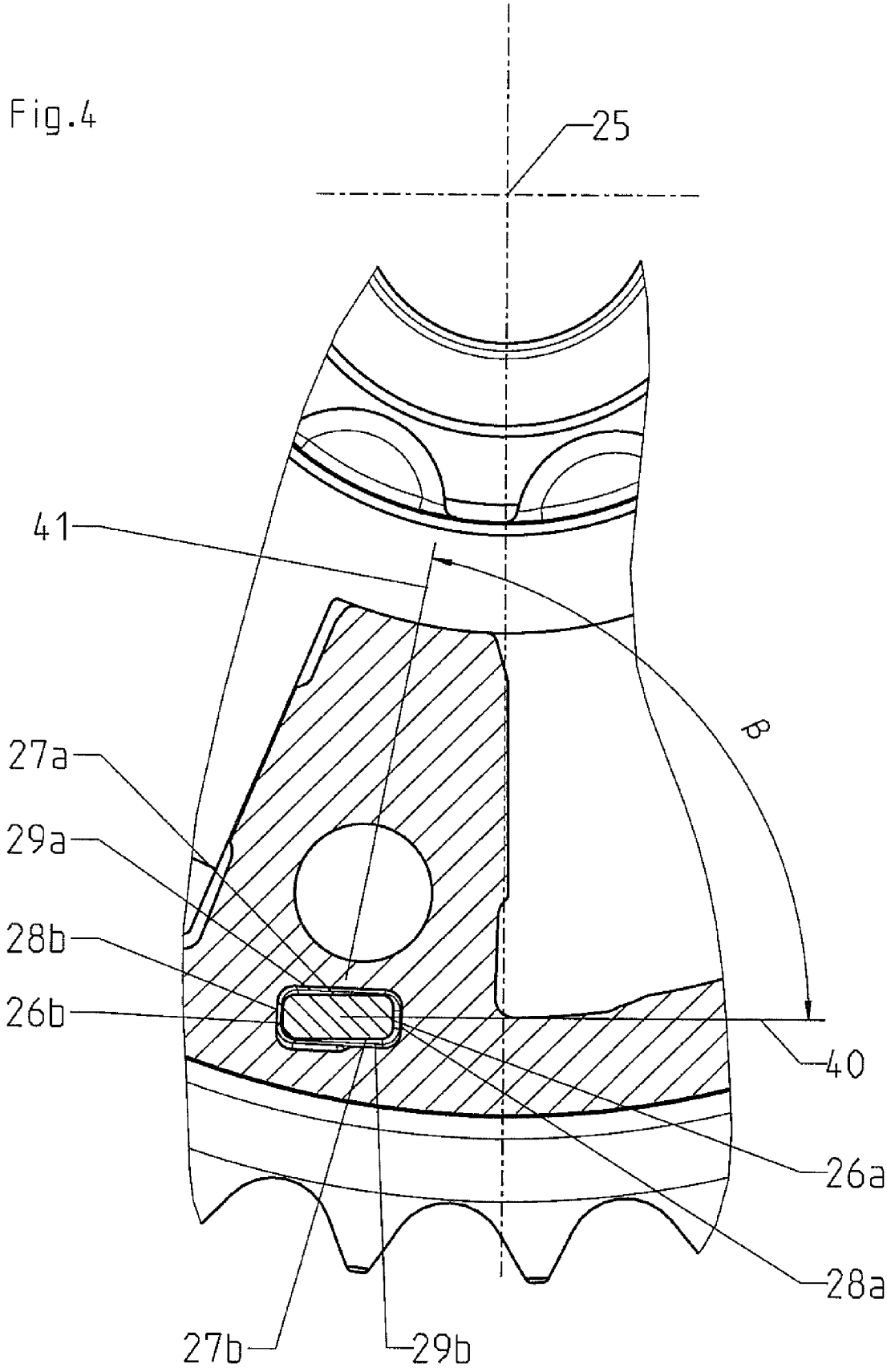

FIG. 4 shows that the accommodating recess 24 of the stator 1 also has a rectangular base shape with deviating edge lengths corresponding to the profile of the coil spring 12. For this purpose the longer edges 29*a*, 29*b* of the accommodating recess 24 are tilted toward the interior as opposed to a tangent of the stator 1 such that an angle $\beta<90°$ is formed between

- the longitudinal extension 40 of the cross-sectional surface of the accommodating recess 24 and
- a line 41 extending from the center of the cross-sectional surface of the accommodating recess 24 to the center axis 25.

The shorter edges 28*a*, 28*b* are at a right angle to the long edges 29*a*, 29*b*.

FIG. 2 shows that the windings of the coil spring 12 abut each other in the unstressed state of the vane-type camshaft adjuster.

The vane-type camshaft adjuster may also be utilized in an intake camshaft and/or an exhaust camshaft. The vane-type camshaft adjuster may also be utilized in a single camshaft, which adjusts both the intake gas shuttle vales and the exhaust gas shuttle valves.

The inner end of the coil spring is connected to a component that is pivot-proof relative to the rotor. The component may therefore be the rotor itself. It may also be a pin or a sleeve, which is connected to the rotor in a positive fitting manner, or via a press-fit connection with or without ribbing. Such a pin, or such a sleeve, respectively, is also called a spring adapter, since at least one of the functions thereof is the connection between the rotor and the coil spring.

The rectangular profile of the coil spring may also be square.

An additional spring cover may also be placed on the stator cover, which protects the coil spring from contamination and other environmental influences, and which may also form a friction partner and a "securing device" for the coil spring. The protective cover may also be made of plastic, for example. However, if the vane-type camshaft adjuster is already protected by means of a chain case or belt case, an additional protective cover may not be necessary.

In an alternate embodiment the camshaft adjuster is not driven by a toothed belt or a chain, but instead by a gearwheel of a second camshaft adjuster being arranged in an axially offset manner.

The embodiments described above are merely exemplary embodiments. A combination of the characteristics described for different embodiments is also possible. Further characteristics of the device parts related to the invention, particularly those not described, are obvious from the geometries of the device parts illustrated in the drawings.

The invention claimed is:

1. A vane-type camshaft adjuster having a stator and a rotor; said cam shaft adjuster defining central axis and having a side plane arranged perpendicular to the central axis, a coil spring abutting said side plane and having a radial inner end and a radial outer end; said coil spring being connected at one of said radial outer and inner ends to said rotor and at the other of said radial outer and inner ends to said stator, whereby said coil spring strives to maintain said rotor at a certain angular position opposite said stator, said coil spring having a rectangular profile, wherein a spring section is angled through the side plane such that the coil spring is supported opposite the stator or the rotor in a pivot-proof positive fitting manner;

wherein, the coil spring comprises two opposed longer edges and two opposed shorter edges, the longer edges deviating from the shorter edges, wherein one of the shorter edges faces the side plane and the other of the shorter edges faces away from the same side plane.

2. The vane-type camshaft adjuster according to claim 1, wherein the spring section is the radial outer end of the coil spring, said radial outer end being radial with regard to the central axis, wherein said radial outer end is supported in a pivot-proof positive fitting manner with respect to the stator.

3. The vane-type camshaft adjuster according to claim 2, wherein the spring section is tucked into an accommodating recess of the stator.

4. The vane-type camshaft adjuster according to claim 1, wherein the radial outer end of the coil spring is angled at an angle just below 90° in an unstressed state of the vane-type camshaft adjuster.

5. The vane-type camshaft adjuster according to claim 1, wherein the coil spring is fixed at said radial inner end in a pivot-proof manner with respect to the rotor.

6. The vane-type camshaft adjuster according to claim 5, wherein the coil spring is bent toward the interior of the camshaft adapter at the radial inner end thereof, and the radial inner end of the coil spring being received in a radially aligned recess radial of a component that is connected to the rotor in a pivot-proof manner, or is embodied on the rotor in one piece.

7. The vane-type camshaft adjuster according to claim 6, wherein the component is a spring adapter that is separate from and secured to the rotor to be pivot-proof with respect to the rotor.

8. The vane-type camshaft adapter according to claim 1, wherein the stator includes an accommodating recess which receives an end of said coil spring; said accommodating recess having a rectangular base shape having deviating edge lengths corresponding to the profile of the coil spring, wherein longer edges of the accommodating recess are tilted toward the interior of the camshaft adapter.

9. The vane-type camshaft adjuster of claim 1 wherein the coil spring comprises windings, said windings abutting each other in an unstressed state of the vane-type camshaft adjuster.

* * * * *